US006446464B1

(12) United States Patent
Bernini

(10) Patent No.: US 6,446,464 B1
(45) Date of Patent: Sep. 10, 2002

(54) CONDENSER MODULE AND DRYER

(75) Inventor: Michele Bernini, Scarzara (IT)

(73) Assignee: SKG Italiana SpA, Scarzara (IT)

( * ) Notice: Subject to any disclaimer, the term of this patent is extended or adjusted under 35 U.S.C. 154(b) by 0 days.

(21) Appl. No.: 09/915,991

(22) Filed: Jul. 26, 2001

(30) Foreign Application Priority Data

Oct. 25, 2000 (EP) ..... 00123153

(51) Int. Cl.[7] ..... F25B 43/00; F25B 39/04
(52) U.S. Cl. ..... 62/509; 62/474
(58) Field of Search ..... 62/509, 474, 475

(56) References Cited

U.S. PATENT DOCUMENTS

| | | | | |
|---|---|---|---|---|
| 5,172,758 A | | 12/1992 | Aoki | 165/110 |
| 5,666,791 A | * | 9/1997 | Burk | 62/474 |
| 5,992,174 A | * | 11/1999 | Mittelstrass | 62/474 |
| 6,038,884 A | * | 3/2000 | Dabrowski | 62/509 |
| 6,209,348 B1 | * | 4/2001 | Shinmura et al. | 62/509 |
| 6,223,556 B1 | * | 5/2001 | DeKeuster et al. | 62/509 |
| 6,260,379 B1 | * | 7/2001 | Manwill et al. | 62/509 |
| 6,295,832 B1 | * | 10/2001 | Kato et al. | 62/509 |

FOREIGN PATENT DOCUMENTS

| | | |
|---|---|---|
| DE | 20004438 U | 6/2000 |
| EP | 0769666 A | 4/1997 |
| EP | 0854058 A | 7/1998 |
| EP | 0974793 A | 1/2000 |
| JP | 11257799 | 9/1999 |

* cited by examiner

*Primary Examiner*—William C. Doerrler
(74) *Attorney, Agent, or Firm*—Armstrong, Westerman & Hattori, LLP

(57) ABSTRACT

In a condenser module M for vehicular air-conditioning system a sub-cooler part positioned below a condenser part is constituted by a sub-cooler tube body R structurally separated from said condenser part K, said tube body extending substantially parallel to and along a lower side 4 of said condenser casing G and containing a dryer equipment as well as at least one collector chamber B for refrigerant.

5 Claims, 2 Drawing Sheets

CONDENSER MODULE AND DRYER

Figure 1:
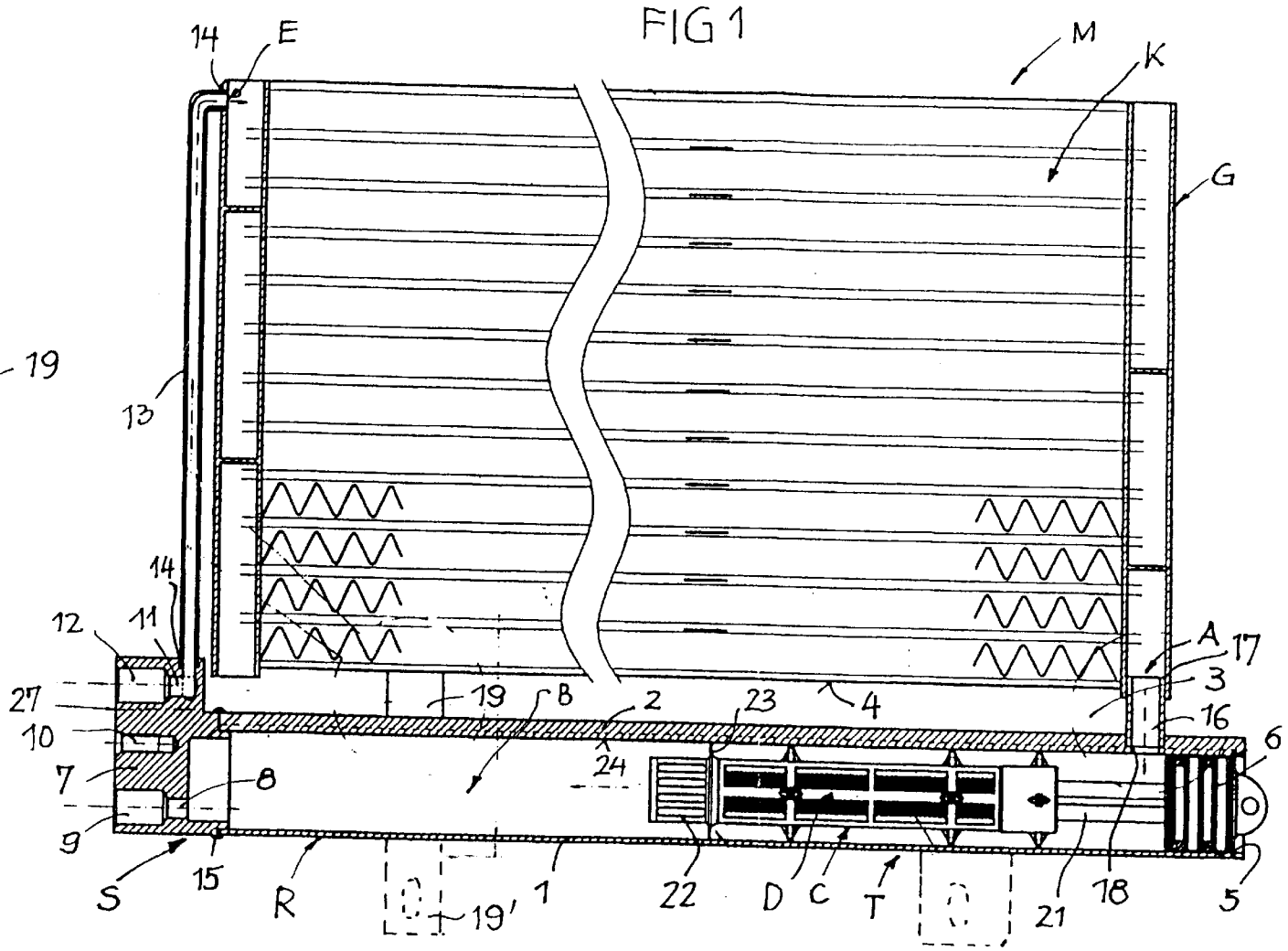

The invention relates to a condenser module according to the preamble part of claim 1 as well as to a dryer according to the preamble part of claim 10.

In a condenser module as known from EP 0 974 793 A the sub-cooler part is a receiver designed as a sub-cooler tube body detachably mounted to the lower side of the condenser casing by a plug connection between an inlet head block at the lower end of a header pipe of the condenser module and a head block of the receiver and by a screw or bracket connection between another head block of the receiver and a lower side member of the condenser casing. The receiver is prefabricated and pre-equipped with its dryer equipment. The receiver has to be connected to the condenser casing after welding or brazing the condenser casing, because the pre-mounted sealings at the head blocks and the confined dryer equipment cannot withstand the high temperatures of the welding or brazing process of the condenser casing.

In a condenser module as known from EP 0 689 014 A, DE 43 19 293 A and DE 44 02 927 A, a sub-cooler section is provided within the condenser casing and in the NOCOLOK-brazed flat tube condenser, said sub-cooler section forming an integrated sub-cooler. A connection line leads from the outlet of the sub-cooler to a dryer located at the side of the condenser casing, said dryer containing the dryer equipment.

In a condenser module as known from EP 0 480 330 a dryer container is directly mounted to the condenser casing by means of a mounting block, said dryer container serving to receive a by-passing partial refrigerant amount. Fluid-tight connections are established by mounting the respective mounting block to the condenser casing. In case that a sub-cooler is needed this will be integrated into the condenser casing.

In a condenser module as known from EP 0 769 666 A the dryer containing the dryer equipment directly is secured at the condenser casing by a mounting block which when mounted simultaneously provides fluid-tight connections. Said dryer may have an oval extruded casing With cooling fins and is mounted separately at one lateral side of the condenser casing . In case that a sub-cooler is provided this is integrated into the condenser casing. The dryer is detachable from the condenser module.

In a condenser known from DE-U-200 04 438 a removable filter cartridge containing a desiccant charge is inserted into a collector tube such that all of the refrigerant has to pass said cartridge. The collector tube is closed by a detachable plug. Said plug is an integrated part of said cartridge.

In a condenser module as known from JP 11 257799 A (Patent Abstracts of Japan, Vol. 1999, No. 14, Dec. 22, 1999) a sub-cooler part is detachably secured to two header pipes of the condenser casing by means of screw connections and co-acting flange structures. The sub-cooler is a prefabricated unit, closed at both ends, and pre-equipped with filters and a desiccant charge. The sub-cooler has to be secured to the condenser casing after brazing or welding the condenser casing .

It is a task of the invention to provide a condenser module and a dryer as mentioned above, both allowing a fair cost, compact structure despite a sub-cooler function.

Said task can be achieved with the features of claim a or the features of independent claim 10.

The sub-cooler tube body forms a sub-cooler section of the condenser module outside of the condenser casing. Within the region below the lower side of the compact condenser casing even under narrow mounting conditions sufficient space is provided to mount the separate sub-cooler tube body with customised dimensions for the required sub-cooler capacity. Since the sub-cooler tube body in combination constitutes the collector chamber needed for the sub-cooler function and also has the dryer equipment, no separate dryer has to be provided for the condenser module. This simplifies manufacturing, reduces the manufacturing costs and decrease s the necessary mounting space for the condenser module. The sub-cooler tube body can be prefabricated separately from the condenser casing and can be dimensioned as required. The fluid tight connection between the outside of the condenser casing and the sub-cooler tube body can be established while said one end of said sub-cooler tube body is left open, preferably simultaneously when brazing said condenser casing. With the help of the plug the dryer equipment can be inserted, positioned and sealed to the exterior later.

The dryer in addition to its task to filter the refrigerant and to extract water also provides the function of a sub-cooler section of a condenser module. It is designed in its dimensions not only for the dryer task but also in view to an extreme space saving structural combination of the sub-cooler function with the condenser casing resulting from the coupling tube secured into a lateral bore of said sub-cooler tube body, and from the plug integrated into said dryer equipment which plug removably closes one end of said sub-cooler tube body.

Further preferred embodiments are contained in the depending claims.

Figure 2:
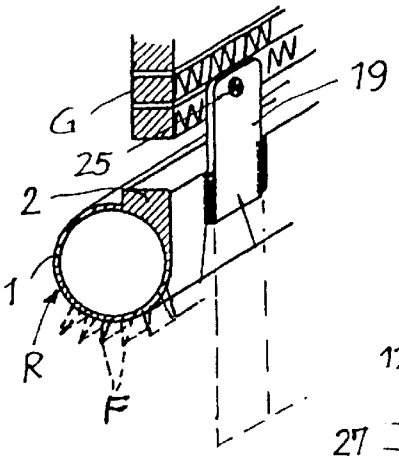

Embodiments of the invention will be explained with the help of the drawing. In the drawing is:

FIG. 1 a front view of a condenser module, partially in section,

FIG. 2 perspectively a detail of the condenser module of FIG. 1, and

Figure 3:
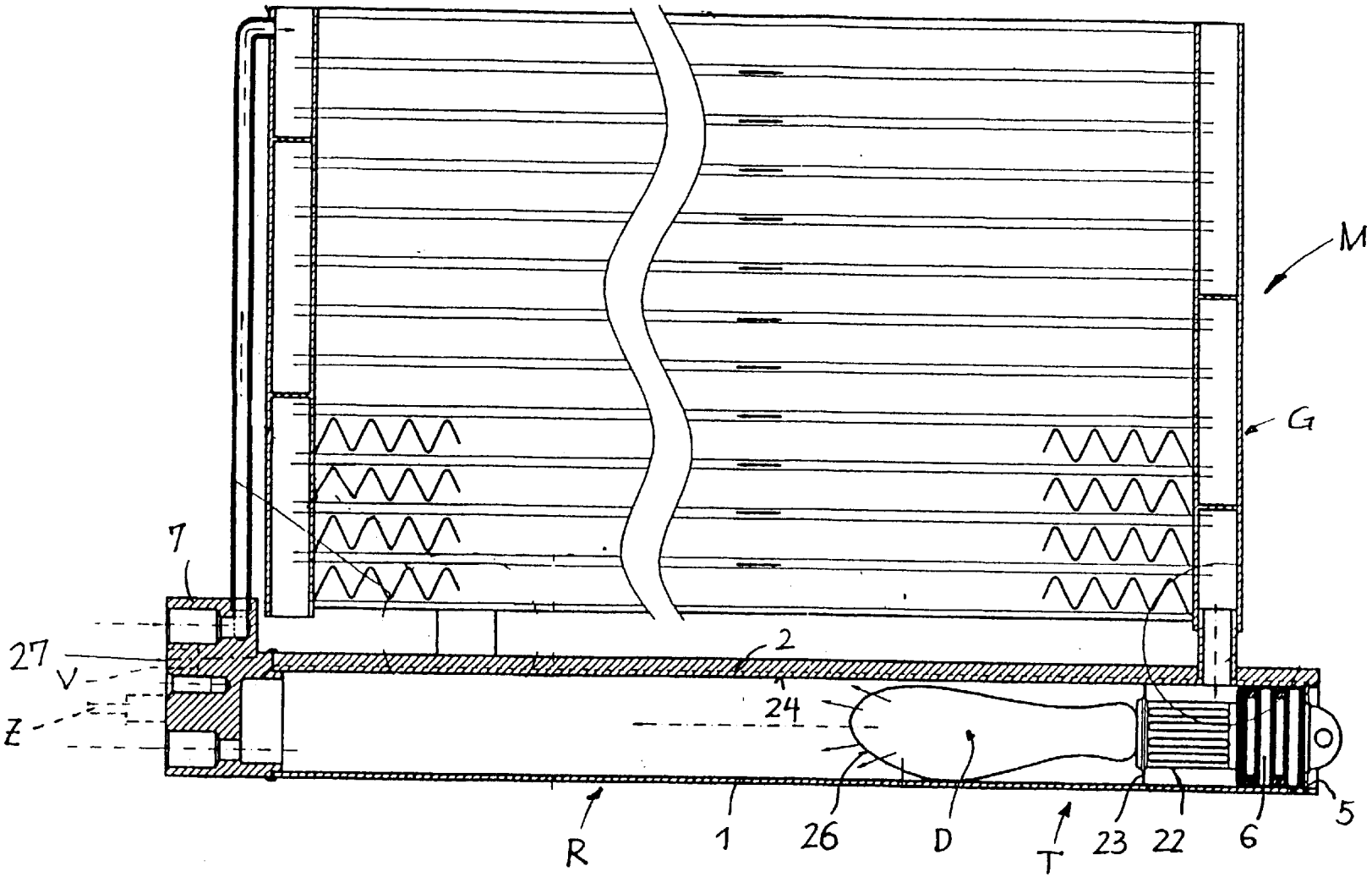

FIG. 3 a further embodiment of a condenser module.

A condenser module M in FIG. 1 includes a condenser casing G receiving a condenser part K and a sub-cooler part S which is formed as a prefabricated sub-cooler tube body R made from metal, particularly light metal like aluminium, which is separated from casing G, and which is provided below a lower side 4 of casing G with an intermediate gap 3 and at least substantially parallel to said lower side 4. Said sub-cooler tube body R consists of a round tube 1 and an outer structurally integrated longitudinal rib 2 (FIG. 2) which is substantially as thick as the casing G and protrudes beyond the outer circumference of said round tube 1.

Said sub-cooler tube body R contains inside a free collector chamber B and a dryer equipment, i.e., by means of said sub-cooler tube body said sub-cooler part S is constituted with an integrated dryer. Said dryer equipment comprises in FIG. 1 a plug 6 which is inserted in sealing fashion into an end opening 5 and which unified by means of a spacer element 21 with a cage-like shell C such that it is positioning shell C within sub-cooler tube body R. Moreover, a filter 22 is provided separated from shell C by a circumferential separation wall 23 sealingly co-acting with an inner wall 24 of sub-cooler tube body R. Shell C contains a desiccant charge D. Thanks to the separation wall 23 the refrigerant has to pass the desiccant charge D when flowing into and through filter 22.

At the opposite end of the sub-cooler tube body R a head block 7 made from metal is secured as a cover of collector chamber B, expediently welded or brazed at 15. A flow passage 8 extending into collector chamber B is formed within head block 7. Said passage 8 is open towards a connection 9 for a refrigerant pipe or an expansion valve, respectively. In a threaded bore 10 connection components can be mounted on head block 7. Moreover, a further flow passage 11 is formed within head block 7 open towards a connection 12 for a refrigerant pipe and continued at its other side by a tube section 13. Tube section 13 connects via passage 11 connection 12 to an inlet E of condenser casing G. At locations 14 tube section 13 is brazed into head block 7 and into the condenser casing G, expediently simultaneously when brazing the condenser part K.

Between an outlet A of condenser part K and the interior of sub-cooler tube body R a flow connection is provided formed by coupling tube 16 inserted into a fitting bore in condenser casing G and a lateral bore 18 of sub-cooler tube body R and brazed in place at locations 17, expediently simultaneously when brazing the condenser part K.

Sub-cooler tube body R is secured to condenser casing G by holding brackets 19 (FIG. 2) which, e.g., are riveted at 25 and are brazed or welded to longitudinal rib 2. Said holding brackets 19 could be prolonged downwardly (indicated by dotted lines at 19') and could then be used as holding brackets for mounting the entire condenser module M.

According to FIG. 2 (indicated by dotted lines) cooling fins F could be formed at the sub-cooler tube body R. Expediently said sub-cooler tube body R is an extruded profile section cut to the needed length, and to which head block 7 is brazed.

The embodiment of FIG. 3 has the same prerequisites as FIGS. 1 and 2. Only the dryer equipment of dryer D provided within sub-cooler tube body R is different. Plug 6, by which the dryer equipment is positioned and sealed against the exterior is directly connected to filter 22 having separation wall 23 for co-action with inner wall 24. In continuation of filter 22 the desiccant charge D is received in a permeably bag 26 freely provided in the interior of sub-cooler tube body R.

In both embodiments the dryer equipment can be inserted and positioned in sub-cooler tube body R with the help of plug 6 and can be removed for replacement with plug 6. The longitudinal extension of the sub-cooler tube body R substantially corresponds to the longitudinal extension of condenser casing G, i.e., sub-cooler part S protrudes both side surfaces of casing G only a little. A structure could be provided at which the sub-cooler tube body R is shorter than casing G. According to FIG. 2 the dimension of sub-cooler tube body R in a direction according to the thickness of the casing G is somewhat larger than the thickness of the casing G. Within head block 7 a further flow passage could be formed useable for e.g. mounting temperature or pressure sensor or the like.

What is claimed is:

1. Condenser module, particularly for vehicle air-conditioning systems, comprising a condenser part (K) provided within a condenser casing (G) and a sub-cooler tube body (R) structurally separated from and positioned in operation position below said condenser part (K) and substantially parallel to and along the lower side (4) of said condenser casing (G) with a fluid tight flow connection provided between said sub-cooler part and an outlet (A) of said condenser casing (G), said sub-cooler part containing a dryer equipment and at least one collector chamber (B), characterised in that said flow connection comprises a coupling tube (16) secured by brazing or soldering in a bore of said outlet (A) and in a lateral bore (18) of said sub-cooler tube body (R); that said sub-cooler tube body (R) is closed at one end by a removable plug (6) which is integrated into said dryer equipment; and that another end of said sub-cooler tube body (R) is closed by a head block (7) which contains a passage (8) with a connection (9) for a refrigerant pipe or an expansion valve and a further passage (11) with a connection (12) for a refrigerant pipe, said connection (12) being connected to a condenser inlet (E) by a tube section (13) secured by brazing to said head block (7) and said condenser inlet (E).

2. Condenser module as in claim 1, characterised in that said coupling tube (16) and said tube section (13) both are brazed in position simultaneously when brazing said condenser casing (G).

3. Condenser module as in claim 1, characterised in that said sub-cooler tube body (R) is secured to said condenser casing (G) by means of at least one holding bracket (19).

4. Condenser module as in claim 3, characterised in that said sub-cooler tube body (R) is a round tube (1) having an outside longitudinally continuing longitudinal rib (2) the thickness of which substantially is corresponding to the thickness of said condenser casing (G), and that said lateral bore (18) and said holding bracket (19) are provided within and at said longitudinal rib (2), respectively.

5. Condenser module as in claim 1, characterised in that said dryer equipment comprises at least one filter (22), at least one desiccant charge (D), and at least one separation wall (23) situated between said filter and said desiccant charge in abutting relationship with an inner wall (24) of said sub-cooler tube body (R), wherein said desiccant charge (D) is provided within a permeable bag (26) or within a cage-like shell (C), and said plug is integrated into said dryer equipment either by direct unification with said cage-like shell or by indirect unification with said cage-like shell, or by direct unification with said filter, respectively.

* * * * *